US012624521B2

(12) United States Patent
Cornelius

(10) Patent No.: US 12,624,521 B2
(45) Date of Patent: May 12, 2026

(54) SUBMERSIBLE UNDERWATER DREDGE WITH INTEGRATED METAL DETECTOR

(71) Applicant: Billie Gene Cornelius, Houston, TX (US)

(72) Inventor: Billie Gene Cornelius, Houston, TX (US)

( * ) Notice: Subject to any disclaimer, the term of this patent is extended or adjusted under 35 U.S.C. 154(b) by 93 days.

(21) Appl. No.: 18/625,929

(22) Filed: Apr. 3, 2024

(65) Prior Publication Data

US 2025/0314039 A1 Oct. 9, 2025

(51) Int. Cl.
*E02F 5/30* (2006.01)
*E02F 3/88* (2006.01)
*E02F 5/00* (2006.01)

(52) U.S. Cl.
CPC ..... *E02F 5/30* (2013.01); *E02F 3/88* (2013.01); *E02F 5/006* (2013.01)

(58) Field of Classification Search
USPC ..... 37/317–323; 324/326; 299/8
See application file for complete search history.

(56) References Cited

U.S. PATENT DOCUMENTS 921,910 A * 5/1909 Swintek ..... E02F 3/92 37/317
2,003,779 A * 6/1935 Yedd ..... E21C 50/00 175/6
2,605,090 A * 7/1952 Oscar ..... E21C 50/00 299/8
4,352,251 A * 10/1982 Sloan ..... E02F 3/02 37/333
4,854,058 A * 8/1989 Sloan ..... E02F 3/88 210/241
4,889,391 A * 12/1989 Cornelius ..... E02F 3/8891 299/9
5,966,847 A * 10/1999 Nathenson ..... E02F 3/9206 137/874
6,000,151 A * 12/1999 Hayes ..... E02F 3/90 175/67

(Continued)

OTHER PUBLICATIONS

"Diver Operated Dredge Pump," sold by DAE Pumps, https://www.daepumps.com/products/diver-operated-dredge/, 2023, 7 pgs.

*Primary Examiner* — Christopher J Sebesta
*Assistant Examiner* — Audrey L Lusk
(74) *Attorney, Agent, or Firm* — Crowe & Dunlevy LLC; Jeremy B. Berman

(57) ABSTRACT

Disclosed herein is a hand-held underwater dredge integrated with a metal detector, designed for locating and retrieving metallic objects from aquatic environments. Equipped with a suction-generating electric pump and powered by an onboard battery to enable operation while fully submerged, the dredge features a pipe system leading to a catch can that captures metal items while expelling the water drawn into the pipe system by the generated suction. In operation, users scan a riverbed, seabed, or lakebed using the metal detector. Once a metal item is detected, the user places the suction end of the pipe system over the metal item and activates the electric pump to start the suction, leading to capture of the metal item in the catch can for retrieval. This streamlines the process of underwater treasure hunting, combining detection and collection into a single user-operated system.

8 Claims, 3 Drawing Sheets

(56) References Cited

U.S. PATENT DOCUMENTS 6,851,206 B2 * 2/2005 Crawley ..... E21C 45/00
37/317
6,957,506 B1 * 10/2005 Fair ..... E02F 5/00
299/9
7,334,358 B1 * 2/2008 Whyte ..... E02F 3/8891
37/324

* cited by examiner

SUBMERSIBLE UNDERWATER DREDGE WITH INTEGRATED METAL DETECTOR

TECHNICAL FIELD

The technical field of this invention pertains to submersible excavation devices, specifically to a hand-held, submersible dredge with integrated metal detection capabilities for underwater treasure hunting and retrieval.

BACKGROUND

Metal detectors have become indispensable tools for locating lost items for retrieval such as coins, jewelry, and other valuable artifacts. The allure of "treasure hunting" and the quest to recover lost belongings drives the use of metal detectors in various environments. As an example, these items may be buried within lakebeds, riverbeds, and seabeds submerged under the water of those bodies. However, retrieving detected objects from underwater poses unique challenges.

Traditional dredging equipment, designed for excavating or removing submerged materials in lakebeds, riverbeds, and seabeds, often falls short for individual treasure hunters due to its size, complexity, and weight. Additionally, the process of locating items with a metal detector and then switching to dredging equipment for retrieval can be cumbersome and time-consuming. This transition might result in losing the precise location of the found items.

Therefore, integrating metal detection capabilities into a hand-held, submersible dredge, a solution not yet available in the art, would significantly enhance the efficiency of locating and retrieving metallic objects from aquatic environments.

SUMMARY

To meet the above-described need for a hand-held, submersible dredge, development efforts have been undertaken by the Inventor to merge detection of items and retrieval of those items into a single, handheld device. To that end, the invention as described herein is directed to a versatile hand-held underwater dredge integrated with a metal detector, designed for locating and retrieving metallic objects from aquatic environments. Equipped with a suction-generating electric pump and powered by an onboard battery to enable operation while fully submerged, the submersible dredge features a pipe system leading to a catch can that filters and captures metal items while expelling the water drawn into the pipe system by the suction generated by the electric pump. In operation, users scan a riverbed, seabed, or lakebed using the metal detector. Once a metal item is detected, the user can place the suction end of the pipe system over the metal item and activate the electric pump to start the suction, securely capturing the object in the catch can for retrieval. This all-in-one solution streamlines the process of underwater treasure hunting, combining detection and collection into a single user-operated system.

DETAILED DESCRIPTION

The following disclosure enables a person skilled in the art to make and use the subject matter described herein. The general principles outlined in this disclosure can be applied to embodiments and applications other than those detailed above without departing from the spirit and scope of this disclosure. It is not intended to limit this disclosure to the embodiments shown, but to accord it the widest scope consistent with the principles and features disclosed or suggested herein.

Figure 1:
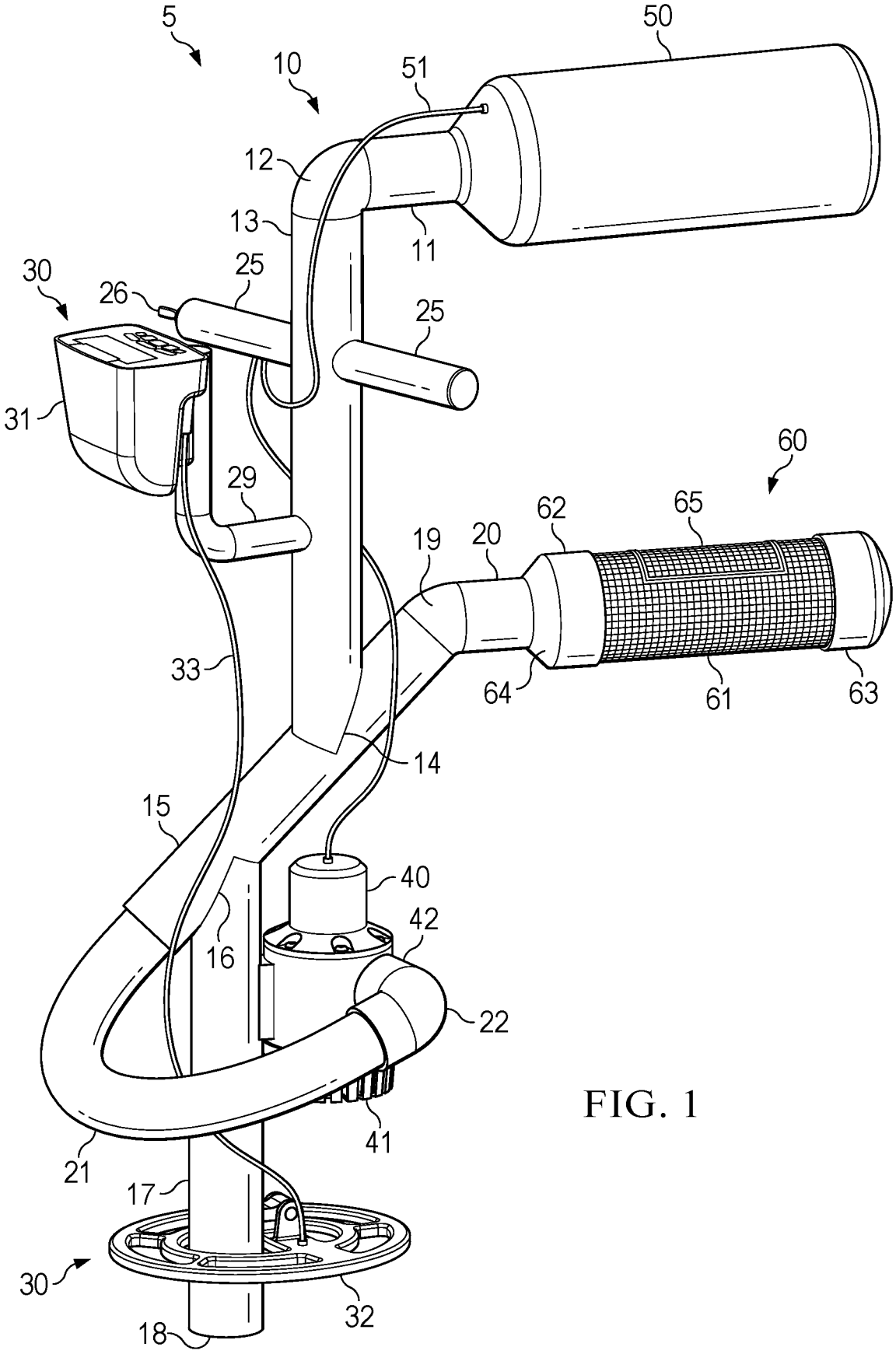
FIG. 1 is a perspective view showing the left side of a submersible underwater dredge disclosed herein.
Figure 2:
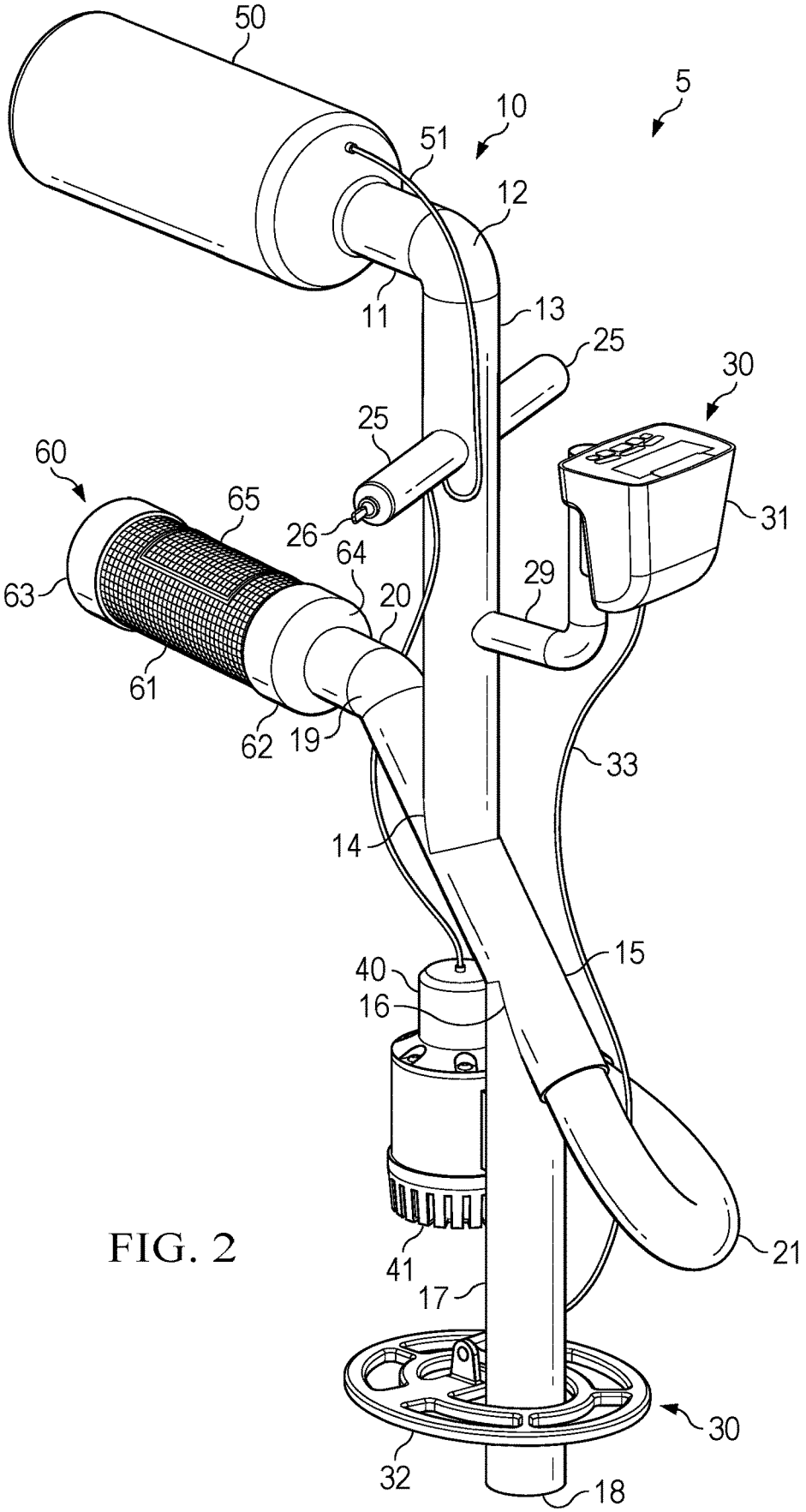
FIG. 2 is a perspective view showing the right side of a submersible underwater dredge disclosed herein.
Figure 3:
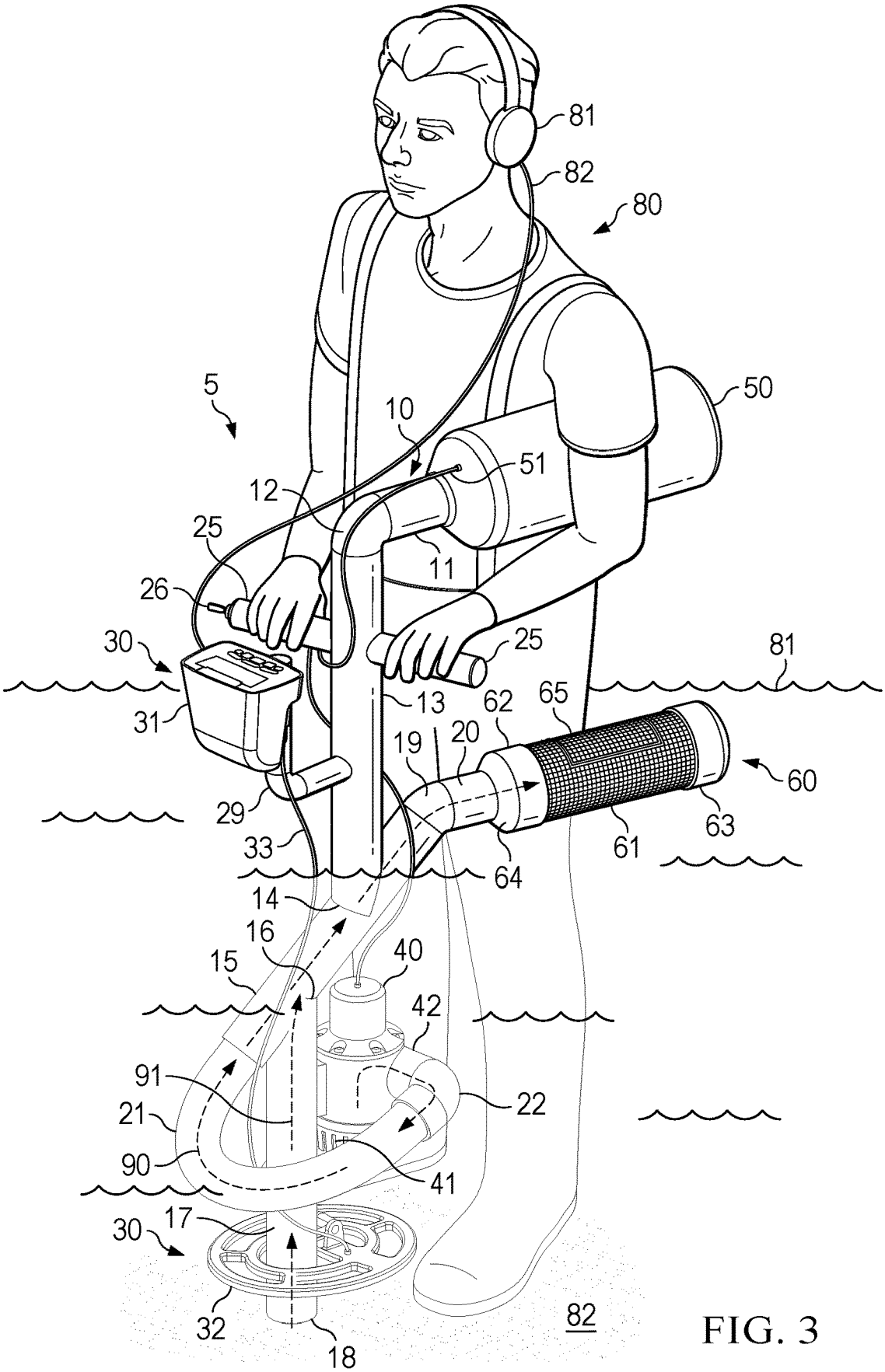
FIG. 3 is a diagrammatical view showing the submersible underwater dredge disclosed herein, when in use by a user.

With reference to FIGS. 1-3, a submersible underwater dredge 5 having an integrated metal detector 30 is now described. The submersible underwater dredge 5 includes a pipe 10 which carries the metal detector 30 for detection of metals, an electric pump 40 for generating a suction into a distal end opening 18 of the pipe 10 and a corresponding blowing out of a distal end opening 20 of the pipe 10 into a catch can 60, and a battery housing 50 for powering the electric pump 40 and metal detector 30.

General details of use are now provided. After this, explicit details of the submersible underwater dredge 5 and its use will then be given. In use, the user wades into a body of water and sweeps the submersible underwater dredge 5, with the metal detector 30 activated, over the bed of the body of water. Upon detecting a metal object, the metal detector 30 notifies the user. The user places the distal end opening 18 of the pipe 10 over the detected metal object, activates the electric pump 40 to initiate suction, and pushes down. The metal object is then drawn into the pipe 10 and trapped in the catch can 60. The user can then retrieve the captured metal item from the catch can 60 for inspection.

In greater detail, the pipe 10 includes a lower pipe portion 17 extending between and in fluid communication with the distal end opening 20 and a first pipe junction 16. The first pipe junction 16 is defined as an opening into a mid-pipe portion 15, the mid-pipe portion 15 extending between and in fluid communication with a curved pipe portion 21 and first pipe elbow 19. An upper pipe portion 13 extends second pipe junction 14 and second pipe elbow 12, the second pipe junction 14 being defined as a non-fluidic mechanical coupling between mid-pipe portion 15 and upper pipe portion 13. The first pipe elbow 19 is connected between mid-pipe portion 15 and first orthogonal pipe extension 20, while the second pipe elbow 12 is connected between upper pipe portion 13 and second orthogonal pipe extension 11.

The first orthogonal pipe extension 20 extends between and in fluid communication with the first pipe elbow 19 and the inlet 64 to the catch can 60, the inlet 64 being defined as an opening in a first end-cap 62 of the catch can 60. A wire mesh cage 61 extends between the first end-cap 62 and a second end-cap 63 of the catch can 60, with the mesh-size of the wire mesh cage 61 being such that water can freely pass through the wire mesh cage 61, but solid metallic objects remain captured within the wire mesh cage 61 and unable to pass through the wire mesh cage 61 to the external environment. A door 65 is hingeably connected to the wire mesh cage 61 to permit easy access to the interior of the wire mesh cage 61 by a human hand, with the door 65 itself being formed of wire mesh.

The second orthogonal pipe extension 11 extends between the second pipe elbow 12 and a battery housing 50, which carries a battery for powering the electric pump 40 and metal detector 30. To that end, wires (e.g., power and ground) 51 extend between the battery within the battery housing 50 and the motor 40, as well as between the battery housing 50 the metal detector 30

The curved pipe portion 21 extends between and in fluid communication with the mid-pipe portion 15 and third pipe elbow 22, which extends between and in fluid communication with the curved pipe portion 21 and an outlet 42 of the electric pump 40.

A handle cross-piece 25 is mechanically connected to the upper pipe portion 13, and carries a switch 26 used to turn the electric pump 40 on or off.

The metal detector 30 includes search coil 32 and control box 31. The search coil 32 fits about the lower pipe portion 17 and is either rigidly mechanically connected to the exterior of the lower pipe portion 17 or slidably mechanically connected to the exterior of the lower pipe portion 17 by a spring apparatus (not shown). An upward-facing elbow 29 is mechanically connected to the upper pipe portion 13, and carries the control box 31. The control box 31 contains the electronics for operating the metal detector 30, and is electrically connected to the search coil 32 via wires 33.

In operation, shown in FIG. 3, the user 80 carries the submersible underwater dredge 5 into the body of water 81, activates the metal detector 30 via switches or controls on the control box 31, and sweeps the submersible underwater dredge 5 over the riverbed, lakebed, or seabed 82. The control box 31 drives the search coil 32 and processes the signal from the search coil 32, adjusting the sensitivity and discrimination of the search coil 32 to detect metallic objects. The search coil 32, sensitive to electromagnetic fields, transmits an electromagnetic field into the riverbed, lakebed, or seabed 82; when it encounters a metal object, the field is disturbed, and the search coil 32 detects this change, signalling the control box 31 to alert the user. As shown in FIG. 3, the control box 31 may audibly provide this alert to the user 80 via a set of waterproof headphones 81 connected to the control box 31 by wire 82 and worn by the user 80.

With the user 80 being alerted of the presence of a metallic object, the user 80 then holds the submersible underwater dredge 5 generally orthogonally to the riverbed, lakebed, or seabed 82 and presses down so that the distal end opening 18 of the pipe 10 is close to or in contact with the riverbed, lakebed, or seabed 82. The user then turns switch 26 on.

When the switch 26 is turned on, causing the motor 40 to turn on, the motor 40 draws water in through motor water inlet 41, then forces the water through motor water outlet 42, through the third pipe elbow 22, through the curved pipe portion 21, and into mid-pipe portion 15 as a jet. The water jet flows through mid-pipe portion 15, through first pipe elbow 19, through first orthogonal pipe extension 20, and into catch can 60. This flow of water is illustratively shown as arrow 90 in FIG. 3, and serves to generate suction at the first pipe junction 16 via the venturi effect. The suction at the first pipe junction 16 draws water into lower pipe portion 17 through distal end opening 18 of the pipe 10, and forces this water through first pipe junction 16, joining the water jet in the mid-pipe portion 15—this flow of water is illustratively shown as arrow 91 in FIG. 3.

Along with water, this suction draws silt, sand, loose soil, and metal objects (e.g., gold) from the riverbed, lakebed, or seabed 82 in through distal end opening 18 of the pipe 10, and forces this mixture through first pipe junction 16, joining the water jet in the mid-pipe portion 15 to ultimately be discharged into the catch can 60. The water, silt, sand, and loose soil are forced out through the mesh 61, while the metal objects are retained by the mesh within the catch can 60. The user 80 may then open the door 65 and remove the metal objects.

It should be appreciated that the connection between mid-pipe portion 15 and second pipe junction 14 is a mechanical connection only, and that water does not (and can not) flow from the mid-pipe portion 15, through the second pipe junction 14, and into upper pipe portion 13. Upper pipe portion 13 stays free of water, helping to keep the battery within the battery housing 50 dry.

In conclusion, the invention presents a host of advantages, paramount being its hand-held design, which offers ease of use and operational simplicity. Being tailored for solo operation and relatively light in weight (on the order of 20 lbs), the invention allows for a single user to efficiently locate and retrieve submerged metal objects. Thanks to its electric pump, the invention is fully submersible, making it an ideal tool for treasure hunting divers, both for shallow depths (e.g., 15 ft) and deeper depths (e.g., 200 ft). The integrating metal detection and retrieval capabilities into one unit means that users can not only detect but also collect treasures in one streamlined process, without the need for cumbersome, separate equipment, representing a significant leap forward in the field of underwater exploration and recovery.

Finally, it is evident that modifications and variations can be made to what has been described and illustrated herein without departing from the scope of this disclosure.

Although this disclosure has been described with a limited number of embodiments, those skilled in the art, having the benefit of this disclosure, can envision other embodiments that do not deviate from the disclosed scope. Furthermore, skilled persons can envision embodiments that represent various combinations of the embodiments disclosed herein made in various ways.

The invention claimed is:

1. A hand-held submersible dredging device, comprising:

a pipe apparatus including a lower portion, an intermediate portion, and an upper pipe portion;

the lower portion connected in fluid communication with the intermediate portion;

the intermediate portion connected in fluid communication between a motor outlet connection and a catch can connection;

a non-fluidic mechanical coupling connecting the upper pipe portion to the intermediate portion, wherein the upper pipe portion is sealed from the fluid communication of the intermediate portion to define a dry internal environment within the upper pipe portion;

a battery disposed within the dry internal environment for powering the device;

a metal detector powered by the battery, and comprising a search plate disposed about a distal end of the lower portion;

a catch can connected in fluid communication with the catch can connection;

an electric pump mechanically powered by the battery, and connected to and carried by the lower portion, the electric pump connected in fluid communication with the motor outlet connection such that, when the electric pump is activated while submerged in water, a water jet flowing through the motor outlet connection, intermediate portion, catch can connection, and into the catch can is formed, wherein the water jet causes suction at the distal end of the lower portion via venturi effect, the suction at the proximal end yielding suction at the distal end of the lower portion such that a mixture of water and solids located adjacent the distal end of the lower portion is sucked through the lower portion and into the intermediate portion at which point the water jet forces the mixture into the catch can so that at least some of the solids are retained within the catch can.

2. The hand-held submersible dredging device of claim 1, wherein the metal detector further comprises a control box carried by the upper pipe portion, the control box for driving and reading signals from the search plate.

3. The hand-held submersible dredging device of claim 1, further comprising a t-handle mechanically affixed to the support pipe and a switch carried by the t-handle, the switch electrically connected to the battery and the electric pump for turning the electric pump on and off.

4. The hand-held submersible dredging device of claim 1, wherein, when the hand-held submersible dredging device is in use, the lower portion extends generally vertically, the intermediate portion extends at an incline with respect to the search plate, the motor outlet connection in fluid connection with an outlet of the electric pump and a curved extension pipe connected between and in fluid communication with the intermediate portion and the motor outlet.

5. The hand-held submersible dredging device of claim 1, wherein the catch can includes a first end-cap having an inlet defined therein, the inlet connected in fluid communication with the catch can connection, the catch can further including a second end-cap and a mesh cage extending between the first end-cap and the second end-cap, wherein an opening is defined in the mesh cage and a door is hingeably connected over the opening so as to permit opening of the catch can to remove the retained solids.

6. A method for retrieving submerged metallic objects using a hand-held, submersible dredge with integrated metal detection, the method comprising:

powering on the metal detector integrated with the submersible dredge, where the submersible dredge includes a pipe apparatus with a distal suction end;

manually sweeping the pipe apparatus with the activated metal detector over a submerged surface to scan for metallic objects;

receiving an indication signal from the metal detector upon detection of a metallic object;

placing the distal suction end of the pipe apparatus over the detected metallic object based on the indication signal manually pressing down on a t-handle mechanically affixed to the pipe apparatus to bring the distal suction end into contact with the submerged surface while maintaining a battery in a dry state within an upper pipe portion of the pipe apparatus, the dry state maintained by a non-fluidic mechanical junction positioned between the upper pipe portion and a water-filled intermediate portion of the pipe apparatus;

activating an electric pump connected to the pipe apparatus to initiate suction through the distal suction end, thereby drawing the metallic object into a catch can via the suction created by the electric pump; and extracting the metallic object from the catch can for collection.

7. The method of claim 6, wherein the step of manually sweeping includes manually adjusting settings on the metal detector to enhance sensitivity or discrimination of metal detection.

8. The method of claim 6, wherein the step of receiving the indication signal includes auditory notification through a set of headphones connected to the metal detector.

* * * * *